US005090704A

United States Patent [19]

Dona

[11] Patent Number: 5,090,704

[45] Date of Patent: Feb. 25, 1992

[54] GOLF GAME TARGET

[76] Inventor: Joseph C. Dona, 3 Frick Dr., Irwin, Pa. 15642

[21] Appl. No.: 663,495

[22] Filed: Mar. 1, 1991

[51] Int. Cl.[5] ..... A63B 69/36; A63B 63/02

[52] U.S. Cl. ..... 273/177 R; 273/402; 273/407; 273/181 A

[58] Field of Search ..... 273/177 R, 177 A, 177 B, 273/398, 399, 400, 401, 402, 407, 411, 127 R, 127 B, 56, 181 A

[56] References Cited

U.S. PATENT DOCUMENTS

| | | | |
|---|---|---|---|
| 770,815 | 9/1904 | Malings | 273/176 A |
| 1,567,765 | 12/1925 | Spaulding | 273/176 AA |
| 1,587,295 | 6/1926 | Gammeter | 273/176 AA |
| 1,715,365 | 6/1929 | Hoffman et al. | 273/176 AA |
| 3,356,370 | 12/1967 | Larsen | 273/176 A |
| 3,652,095 | 3/1972 | Furnari et al. | 273/176 AA |
| 3,695,610 | 10/1972 | Thompson | 273/56 |
| 4,111,422 | 9/1978 | Burrenski | 273/402 |
| 4,256,308 | 3/1981 | Schlueter et al. | 273/177 A |
| 4,323,251 | 4/1982 | Loveland | 273/407 |

FOREIGN PATENT DOCUMENTS

| | | | |
|---|---|---|---|
| 658096 | 10/1951 | United Kingdom | 273/177 A |
| 922287 | 3/1963 | United Kingdom | 273/177 A |

*Primary Examiner*—George J. Marlo
*Attorney, Agent, or Firm*—Kirkpatrick & Lockhart

[57] ABSTRACT

A portable golf game to be played with conventional golf balls and golf clubs comprises nine targets adaped to be randomly positioned on an ordinary lawn to thereby provide the player with targets for putting or chipping a golf ball. The targets define a ring-shaped opening adapted to permit a ball to pass therethrough. A single support rod extends perpendicularly from each target and is adapted for insertion into the ground. A sign having a first side and a second side is rigidly attached to each target. The first sides of the signs are consecutively numbered from one to nine while the second sides are consecutively numbered from ten to eighteen. Each sign is numbered so that the sum of the numbers on its first side and its second side equals nineteen. To play the game, the player places a golf ball on either side of the target having the number six affixed thereto and thereafter hits the golf ball toward the target numbered one in an attempt to hit it through the target. Prior to hitting the ball, the player rotates the target so that the opening therein always faces the ball. Play continues in this manner until all of the targets numbered one through eighteen are traversed in order. The player with the least amount of strokes after traversing all eighteen targets wins the game.

12 Claims, 3 Drawing Sheets

Fig.1.
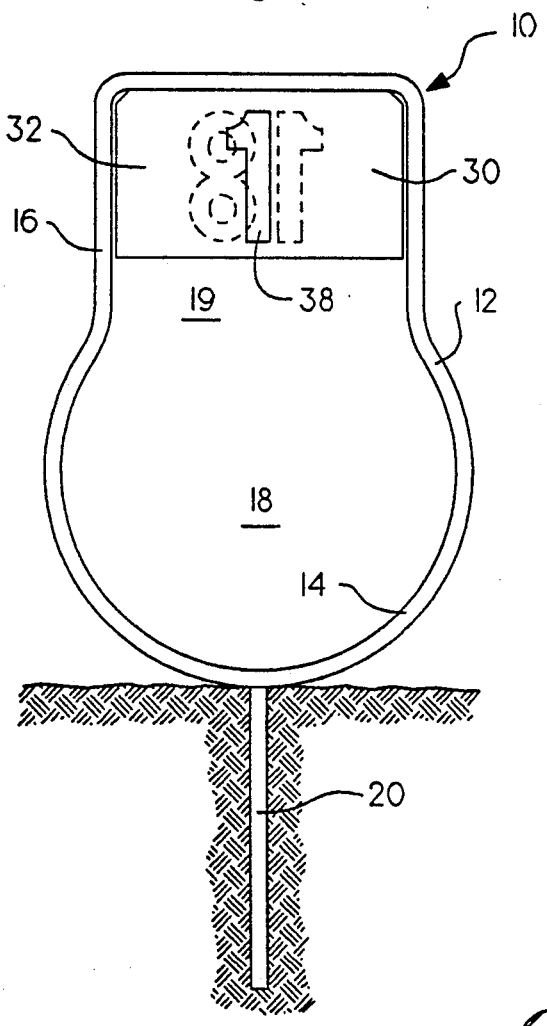
Fig.2.
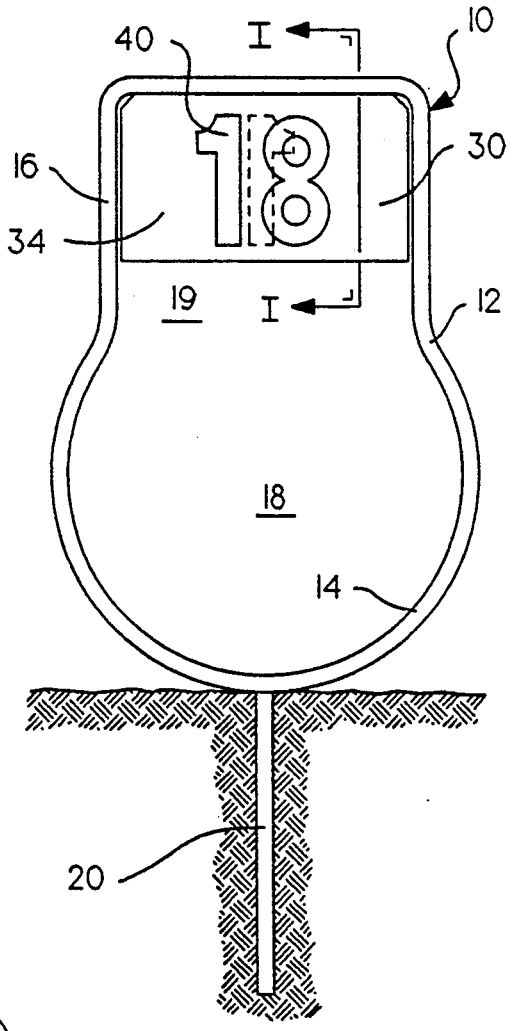
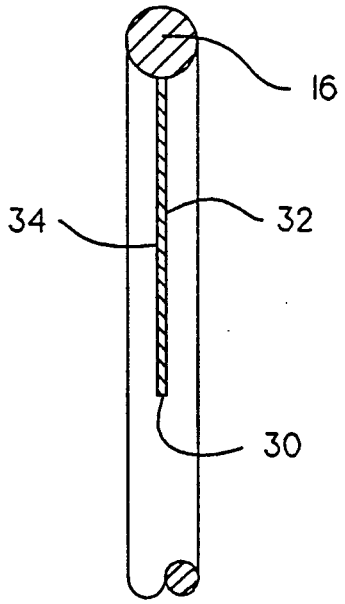
Fig.3.

GOLF GAME TARGET

BACKGROUND OF THE INVENTION

1. Field of the Invention

The present invention relates to a portable golf game and, in particular, to a golf game played with conventional golf clubs and balls on an ordinary lawn.

2. Description of the Invention Background

When an avid golfer is asked to define the key golfing skills required to consistently achieve low golf scores, chipping and putting skills are often mentioned. Every golfer, at one time or another, has arrived at his favorite golf course eager to practice putting and chipping only to find the practice areas fully occupied. The golfer is then forced to either forego his practice altogether or to return home and fashion an artificial golf hole in his yard.

A number of devices and games have been developed to meet that need. The devices disclosed in U.S. Pat. No. 1,587,295; U.S. Pat. No. 1,715,365; U.S. Pat. No. 3,652,095 and U.S. Pat. No. 3,695,610 all provide the golfer with some means for practicing his golf game in his backyard. However, none of those devices are adapted to replicate a golf hole that is accessible from an area projecting 360° around the hole. In all of those devices, because they are incapable of being turned to face the ball before each stroke, the player must maneuver the ball to a position in front of the device before it can be hit through the opening therein. That action is inconsistent with the strokes taken on a golf course as the hole may be accessed from any direction thereabout without first advancing the ball to a predetermined position.

The devices disclosed in U.S. Pat. No. 3,356,370 and U.S. Pat. No. 4,256,308 are adapted to pivot in response to ball contact resulting from an inaccurate shot. However, with both devices, the ball must first be hit to a position in front of the device to advance the ball through the opening therein. For example, a shot taken from the side of the device would hit the device at an angle and thereby cause it to pivot to another position. After the device has pivoted, it may or may not be aligned with the ball. Thus the player may be required to hit the ball to a position in front of the device before he may hit the ball into the device.

In another type of game, such as shown in U.S. Pat. No. 770,815, the wicket devices disclosed therein take the form of ring-shaped targets mounted substantially above the ground. While this type of device could provide a golfer with a target for practicing chip shots, it could not be used to practice putting because it is remotely mounted from the ground.

Thus, the need exists for a compactly designed golf game apparatus with which a golfer can practice putting and chipping under conditions similar to those on an actual golf course.

SUMMARY OF THE INVENTION

In accordance with the present invention, there is provided an improved design for a portable, lawn golf game apparatus. The golf game apparatus includes a ring-shaped target that is rigidly attached to a support member. The ring and the support member lie in the same plane, with the support member extending in a direction perpendicular to the ring. A sign having a first and second side is also attached to the top of the ring.

In the preferred embodiments, nine rings are provided. Each of the nine rings has a number printed on each first side and each second side of the sign. The numbers run consecutively from one to nine on the first sides and from ten to eighteen on the second sides with the number ten appearing on the reverse side of the sign on which the number nine appears. In all cases, the sum of the two numbers on the sign equals nineteen.

To play the game, the rings are placed randomly at various spots on a lawn with the support member of each game piece being inserted into the lawn so that the bottom of the ring is at ground level. A player commences play by placing a golf ball on either side of any of the rings, preferably ring six, and thereafter putting or chipping it toward ring one with a conventional golf club in an attempt to hit the ball through the ring. The player continues to hit the ball until it passes through the ring. However, prior to hitting the ball, the player always turns the ring so that the opening of the ring faces the place where the ball lies. Play is continued in this manner until all of the rings numbered one through nine are traversed in order. Thereafter, the player places the ball on either side of ring six and hits the ball toward ring ten. The player continues in this manner hitting the golf ball through the rings numbered ten through eighteen in consecutive order. It should be noted that other types of golf games other than the one previously discussed can be played with the apparatus of the present invention.

The game may be played by individuals or competing teams using conventional golf clubs and balls or wiffle balls. Individual and/or team scores are maintained as to the number of strokes required by each team or player to complete the course. As in the game of golf, the individual or team with the lowest score wins the game.

Because the rings define circular targets that extend upward from the ground level, the player can either chip or putt the ball therethrough. Also, the portable nature of the rings makes it possible to take the rings to the golf course for times when the putting greens are fully occupied.

Accordingly, the present invention provides solutions to the aforementioned problems encountered when using other lawn golf games. In particular, this invention provides a ring-shaped target that is adapted to be turned to face the ball prior to each stroke to thereby replicate the conditions encountered on an actual golf course. In addition, due to their compact design, a golfer may store the ring-shaped targets in his or her golf bag for those times when the practice greens are occupied. Those and other advantages and benefits of the present invention will become apparent from the description of the preferred embodiments hereinbelow.

BRIEF DESCRIPTION OF THE DRAWINGS

For the present invention to be clearly understood and readily practiced, preferred embodiments will now be described, by way of example only, with reference to the accompanying figures wherein:

FIG. 1 is a front elevational view of a first preferred embodiment of the present invention;

FIG. 2 is a rear elevational view of the embodiment of the present invention as shown in FIG. 1;

FIG. 3 is a cross-sectional view of the embodiment of the present invention as shown in FIG. 2 taken along line I-I;

DETAILED DESCRIPTION OF THE PREFERRED EMBODIMENTS

Figure 4:
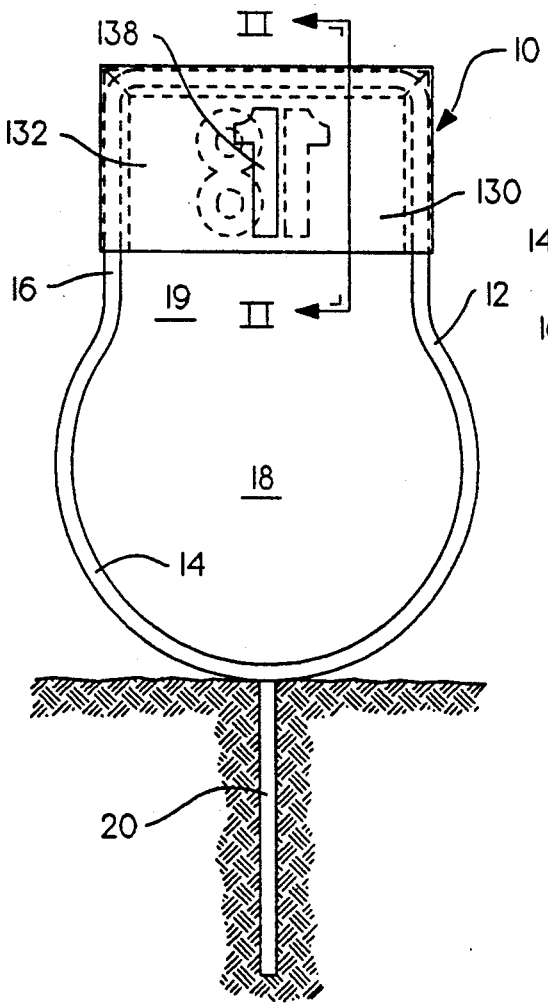
FIG. 4 is a front elevational view of a second preferred embodiment of the present invention.
Figure 8:
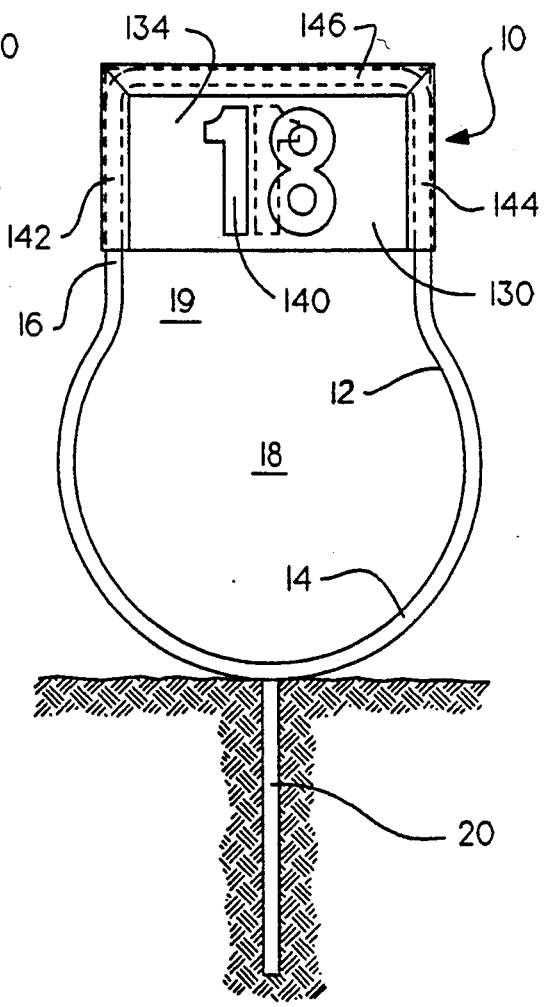
FIG. 8 is a rear elevational view of the embodiment of the present invention as shown in FIG. 4.

Referring now to the drawings for purposes of illustrating the preferred embodiments of the present invention only and not for purposes for limiting the same, the figures show a ring-shaped target for a portable lawn golf game generally designated as 10, constructed according to the teachings of the present invention. Like reference numerals are employed among the various figures to designate like elements.

More particularly and with reference to FIGS. 1 and 2, there is shown a ring-shaped target 10 having a frame member 12, a sign member 30, and a rod-shaped support member 20. Frame member 12 and support member 20 may preferably be constructed from 3/16" diameter mild steel or aluminum rod, however, one of ordinary skill in the art will recognize that frame member 12 and support member 20 may also be constructed from plastic or other suitable materials of various diameters. Typically, the support member 20 will be smooth to facilitate rotation of the target 10. The support member 20 may also be tapered at its tip (not shown) to facilitate insertion into the ground.

In one preferred embodiment, as shown in FIGS. 1, 2 and 3, frame member 12 has a lower portion 14 that defines a substantially circular opening 18 and an upper portion 16 that defines a rectangular opening 19. As can be seen in FIG. 3, frame member 12 preferably has a substantially circular cross-section. Circular opening 18 may be approximately 4.25 inches in diameter. However, by increasing or decreasing that diameter, the degree of difficulty in playing the game may be easily varied. Sign member 30 may preferably be constructed of 0.020" thick steel or aluminum plate having a first side 32 and a second side 34 and may be welded to upper portion 16 of frame member 12 within rectangular opening 19 as shown in FIGS. 1 and 2. Support member 20 extends perpendicularly from bottom portion 14 of frame member 12 and may preferably be welded thereto.

A total of nine ring-shaped targets 10 are required to play the game of the present invention. The first side 32 of each sign member 30 on each of the nine ring-shaped targets 10 has an integer number, designated as 38, printed thereon or attached thereto. The numbers 38 run consecutively from one to nine. In addition, the second side 34 of each sign member 30 located on each of the nine ring-shaped targets 10 has an integer number, designated as 40, printed thereon or attached thereto. The numbers designated as 40, start at ten and run consecutively through eighteen. The number eighteen may be printed on or attached to the second side 34 of the sign member 30 whose first side 32 has the number one printed thereon or attached thereto. That numbering sequence may also be used on the remaining eight ring-shaped targets 10 so that the sum of the numbers designated as 38 and 40 on each sign member 30 equals nineteen. For example, the ring-shaped target 10 having a sign member 30 with the number two printed on or attached to its first side 32 would have the number seventeen printed or attached to its second side 34.

Frame member 12, support member 20, and sign member 30 may be painted with a rust-resistant yellow paint to make them easily visible. Numbers 38 and 40 may preferably be black in color to contrast with the color of sign member 30. However, one of ordinary skill in the art will recognize that targets 10 and numbers 38 and 40 may be provided in various colors.

Figure 6:
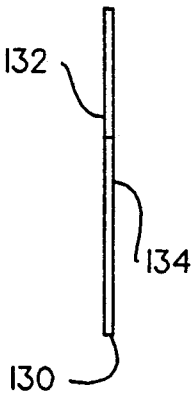
FIG. 6 is a side elevational view of the sign member as depicted in FIG. 4.
Figure 5:
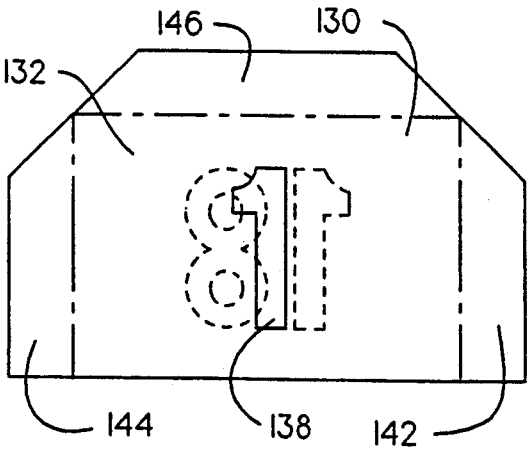
FIG. 5 is a front elevational view of the sign member depicted in FIG. 4.
Figure 7:
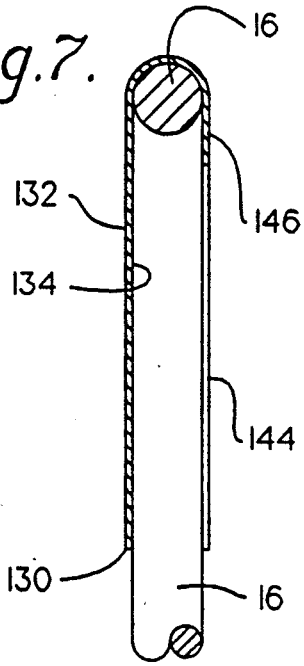
FIG. 7 is a cross-sectional view of the embodiment of the present invention as shown in FIG. 4 taken along line II—II.

In another preferred embodiment of the present invention, as shown in FIGS. 4 through 8, a sign member 130, is crimped over upper portion 16 of frame member 12. In this embodiment, sign member 130 may be constructed of a bendable sheet metal material such as 0.020" thick steel or aluminum sheet. Sign member 130, as shown in FIGS. 5 and 6, has three laterally extending tabs 142, 144, and 146 respectively that are adapted to be folded over upper portion 16 of frame member 12 to thereby rigidly fasten sign member 130 to frame member 12 (see FIGS. 4, 7, and 8). The scheme for applying integer numbers designated as 138 and 140 to the sides 132 and 134 of sign member 130 for each ring-shaped target 10 may be identical to that disclosed in the discussion relating to FIGS. 1 through 3.

Figure 9:
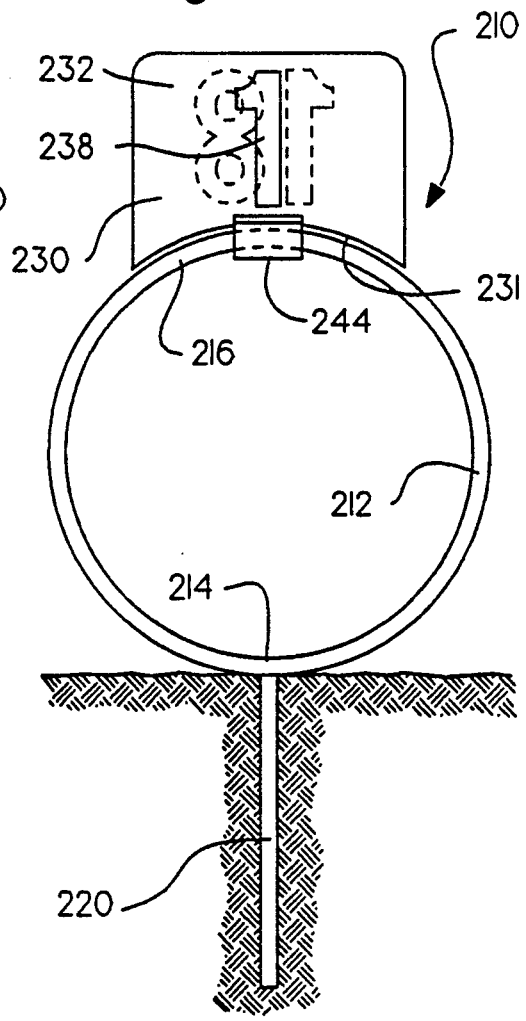
FIG. 9 is a front elevational view of a third embodiment of the present invention.

Another preferred embodiment of the present invention as shown in FIGS. 9 through !2, consists of a ring-shaped target 210 having a circular frame member 212, a support member 220, and a sign member 230. Circular frame member 212 has a lower portion 214 and an upper portion 216. Frame member 212 and support member 220 may preferably be constructed from 3/16" diameter mild steel or aluminum rod. However, one of ordinary skill in the art will recognize that frame member 212 and support member 220 may be constructed from rigid plastic or other suitable materials. Support member 220 extends perpendicularly from lower portion 214 of circular frame member 212 and may preferably be welded thereto.

Figure 10:
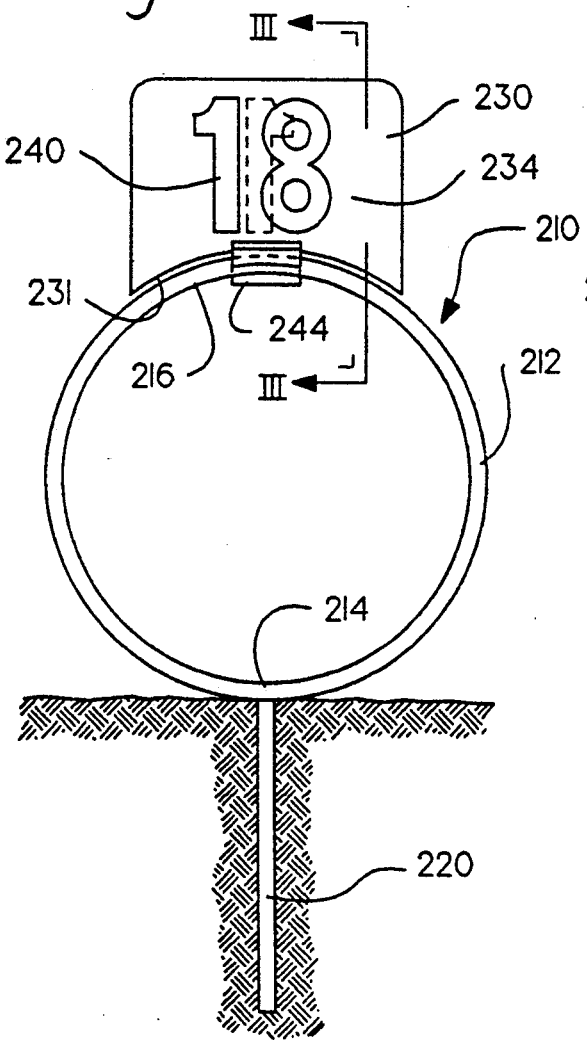
FIG. 10 is a rear elevational view of the third embodiment of the present invention as shown in FIG. 9.

Sign member 230, as shown in FIGS. 9 and 10, may be constructed from rigid plastic and has an arcuate lower edge 231 adapted to conform to the upper portion 216 of circular frame member 212. Sign member 230 has a first side 232 and a second side 234 that employ a numbering scheme for applying numbers 238 and 240 to sides 232 and 234, respectively, which may be identical to that disclosed in the discussion relating to FIGS. 1 through 3.

Figure 11:
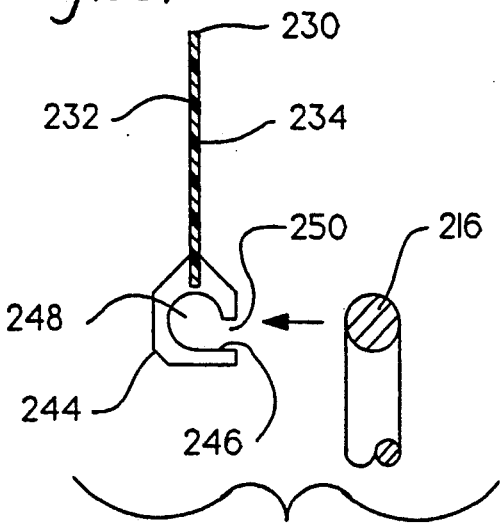
FIG. 11 is a cross-sectional exploded assembly view of the present invention as shown in FIG. 10.
Figure 12:
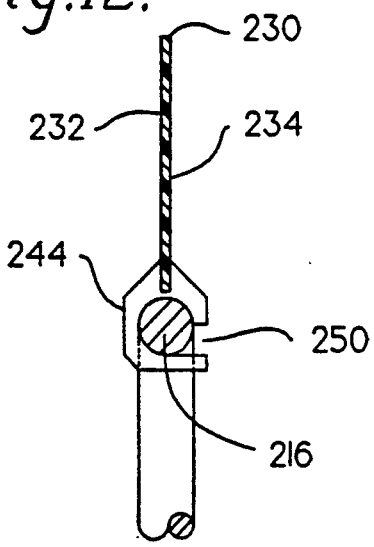
FIG. 12 is a cross-sectional assembly view of the embodiment of the present invention as shown in FIG. 10 taken along line III-III.

A connection tab 244 (FIGS. 11 and 12) which also may be constructed from rigid plastic is centrally disposed along lower edge 231 to facilitate the connection of sign member 230 to the upper portion 216 of frame member 212. Connection tab 244 has a laterally facing groove 246 which defines a semi-cylindrical socket 248, the diameter of which is slightly smaller than the diameter of the material used to make frame 212. The socket 248 of tab 244 opens laterally by way of a narrow opening 250 of a width slightly less than the diameter of semi-cylindrical socket 248. Sign member 230 is fastened to frame member 212 by forcing opening 250 of connection tab 244 over the upper portion 216 of frame member 212 as shown in FIG. 11.

To play the game of the present invention, the nine ring-shaped targets 10 or 210 are placed randomly at various spots on a lawn with the support member 20 or 220 being inserted into the lawn so that lower portion 14 or 214 of frame member 12 or 212 is at ground level. A player then commences play by placing a golf ball or other type of ball, on either side of one of the targets 10, for example, the target that has the number six printed on or attached to its sign member 30 or 230, and thereafter putting or chipping the ball toward the target 10 or 210 that bears the number one in an attempt to hit it through that target 10 or 210. The player continues to putt or chip the ball until it passes through the target 10 or 210. Prior to hitting the ball, the player rotates the target 10 or 210 so that the opening therein faces the place where the ball lies.

After the ball passes through the target 10, the player proceeds to hit the ball from where it lies after passing through the target 10 bearing the number one towards the target 10 bearing the number two. Play continues in this manner until the ball has been hit through each of the targets 10 numbered one through nine in consecutive order. The player then places the ball on either side of the target 10 bearing the number six and thereafter hits the ball toward the target 10 bearing the number 10. As with targets 10 numbered one through nine, the player continues hitting the ball until the ball has passed through the targets 10 numbered eleven through eighteen.

One or more players may play the game. When more than one player is playing, each player hits his ball alternately until each player has taken one stroke before the first player takes a second stroke. Score is kept by counting the number of strokes for each player for each target 10. The player with the lowest total score is the winner.

While the present invention has been described in connection with exemplary embodiments thereof, it will be understood that many modifications and variations will be readily apparent to those of ordinary skill in the art. For example, it will be readily apparent that the size of the ring-shaped target along with the type, size and weight of the balls and clubs being used may easily be modified. This disclosure and the following claims are intended to cover all such modifications and variations.

I claim:

1. A portable apparatus for use in playing a golf game comprising:

a target member defining an opening at least a major portion of which is in the shape of a circle adapted to permit a ball to pass therethrough;

a single support rod rigidly attached to said target member and extending perpendicularly from a central portion of said circle, said support rod adapted for insertion into the ground; and a sign member rigidly attached to said target member opposite said support rod and extending perpendicularly therefrom, said sign member having a first side and a second side, said first side and said second side each having a different identifying number affixed thereto.

2. The apparatus of claim 1, wherein the sum of said identifying numbers equals nineteen.

3. The apparatus of claim 1, wherein said support rood is coplanar with said target member.

4. The apparatus of claim 3, wherein said sign member is coplanar with said target member and said support rod and extends in a direction substantially opposite from said support rod.

5. The apparatus of claim 4, wherein said target member has ann upper portion and a lower portion, said lower portion being rigidly attached to said support rod and said upper portion being rigidly attached too said sign member.

6. The apparatus of claim 5, wherein said target member and said support rod are constructed of bendable steel rod.

7. The apparatus of claim 6, wherein said upper portion of said target member is rectangular in shape.

8. The apparatus of claim 7, wherein said sign member is constructed of sheet steel fastened to said rectangular upper portion of said target member by welding.

9. The apparatus of claim 7, wherein said sign member is constructed of sheet metal having a plurality of laterally extending tabs adapted to be folded over said rectangular upper portion of said target member to thereby rigidly fasten said sign member to said target member.

10. The apparatus of claim 6, wherein said sign member is constructed of plastic.

11. The apparatus of claim 10, wherein said sign member additionally comprises a retaining tab, said retaining tab being adapted to snap onto said upper portion of said target member to rigidly and non-rotatably fasten said sign member to said target member.

12. The apparatus of claim 5, wherein said target member, said support rod, and said sign member are constructed of rigid plastic.

* * * * *

UNITED STATES PATENT AND TRADEMARK OFFICE

CERTIFICATE OF CORRECTION

PATENT NO. : 5,090,704

DATED : February 25, 1992

INVENTOR(S) : Joseph C. Dona

It is certified that error appears in the above-identified patent and that said Letters Patent is hereby corrected as shown below:

On the Title page, item [57] in the Abstract, line 2, delete "adaped" and substitute --adapted -- therefor.
Column 4, line 38, delete "!2" and substitute --12-- therefor.
Column 6, line 3, after "opening" insert a comma.
Column 6, line 2, delete "rood" and substitute --rod-- therefor.
Column 6, line 2 delete "ann" and substitute -- an-- therefor.
Column 6, line 4, delete "too" and substitute --to-- therefor.

Signed and Sealed this

Twenty-fifth Day of May, 1993

*Attest:*

Michael K. Kirk

MICHAEL K. KIRK

*Attesting Officer*

*Acting Commissioner of Patents and Trademarks*